US006863272B2

(12) United States Patent
DiNatale et al.

(10) Patent No.: US 6,863,272 B2
(45) Date of Patent: Mar. 8, 2005

(54) SHEET FEEDING APPARATUS HAVING AN ADAPTIVE AIR FLUFFER

(75) Inventors: Ernest L. DiNatale, Rochester, NY (US); Timothy G. Shelhart, West Henrietta, NY (US); Robert A. Austin, Honeoye, NY (US)

(73) Assignee: Xerox Corporation, Stamford, CT (US)

( * ) Notice: Subject to any disclaimer, the term of this patent is extended or adjusted under 35 U.S.C. 154(b) by 14 days.

(21) Appl. No.: 10/232,555

(22) Filed: Aug. 29, 2002

(65) Prior Publication Data

US 2004/0041328 A1 Mar. 4, 2004

(51) Int. Cl.[7] ..... B65H 3/14
(52) U.S. Cl. ..... 271/97
(58) Field of Search ..... 271/97, 98, 104, 271/105, 106, 107

(56) References Cited

U.S. PATENT DOCUMENTS 4,887,805 A * 12/1989 Herbert et al. ..... 271/94
5,090,676 A * 2/1992 Matsuno et al. ..... 271/12
5,135,213 A * 8/1992 Malachowski et al. ..... 271/104
5,181,706 A * 1/1993 Yamamoto et al. ..... 271/11
5,707,056 A * 1/1998 Rauen et al. ..... 271/96
6,186,492 B1 2/2001 Dechau et al. ..... 271/30.1
6,264,188 B1 7/2001 Taylor et al. ..... 271/98
6,290,225 B1 9/2001 Linder et al. ..... 271/155
6,352,255 B1 3/2002 Taylor ..... 271/104
6,398,206 B1 6/2002 Yang et al. ..... 271/90
6,398,207 B1 6/2002 Taylor et al. ..... 271/106
6,398,208 B1 6/2002 Yang et al. ..... 271/107
2001/0017441 A1 * 8/2001 Yamaguchi et al. ..... 271/94
2002/0105133 A1 * 8/2002 Jensen ..... 271/97

* cited by examiner

*Primary Examiner*—Donald P. Walsh
*Assistant Examiner*—Kenneth W. Bower
(74) *Attorney, Agent, or Firm*—Lloyd F. Bean, II

(57) ABSTRACT

A sheet feeding apparatus for feeding a stack of sheets in a direction of movement to a process station, including: a sheet tray for holding the stack of sheets; an air plenum, positioned above the stack of sheets, for picking up a sheet from the stack of sheets when a vacuum force in the air plenum; a paper fluffer for blowing air between individual sheets in the stack, the paper fluffer having a system for adjusting air flow between individual sheets.

4 Claims, 3 Drawing Sheets

SHEET FEEDING APPARATUS HAVING AN ADAPTIVE AIR FLUFFER

FIELD OF THE INVENTION

This invention relates generally to an electronic reprographic printing system, and more particularly concerns feeder apparatus process for improving feeding of compilations of recording sheets that often accompanies this general method of reproduction and printing.

BACKGROUND OF THE INVENTION

In the process of electrostatographic reproduction, a light image of an original to be copied or printed is typically recorded in the form of a latent electrostatic image upon a photosensitive member, with a subsequent rendering of the latent image visible by the application of electroscopic marking particles, commonly referred to as toner. The visual toner image can be either fixed directly upon the photosensitive member or transferred from the member to another support medium, such as a sheet of plain paper. To render this toner image permanent, the image must be "fixed" or "fused" to the paper, generally by the application of heat and pressure.

With the advent of high speed xerography reproduction machines wherein copiers or printers can produce at a rate in excess of three thousand copies per hour, the need for sheet handling system to, for example, feed paper or other media through each process station in a rapid succession in a reliable and dependable manner in order to utilize the full capabilities of the reproduction machine. These sheet handling systems must operate flawlessly to virtually eliminate risk of damaging the recording sheets and generate minimum machine shutdowns due to misfeeds or multifeeds. It is in the initial separation of the individual sheets from the media stack where the greatest number of problems occur which, in some cases, can be due to up curl and down curl in sheets which generally occur randomly in the document stack.

SUMMARY OF THE INVENTION

There is provided a sheet feeding apparatus for feeding a stack of sheets in a direction of movement to a process station, comprising: a sheet tray for holding said stack of sheets; a paper fluffer, position on a said side portion of said stack of sheets, for blowing air between individual sheets in said stack to keep a top sheet of said stack separated and ready for feeding; and a baffle, position on a top portion of said stack of sheets, for engaging a trailing edge of said top sheet thereby preventing the trailing edge of said top sheet from curling up.

DETAILED DESCRIPTION OF THE INVENTION

Figure 1:
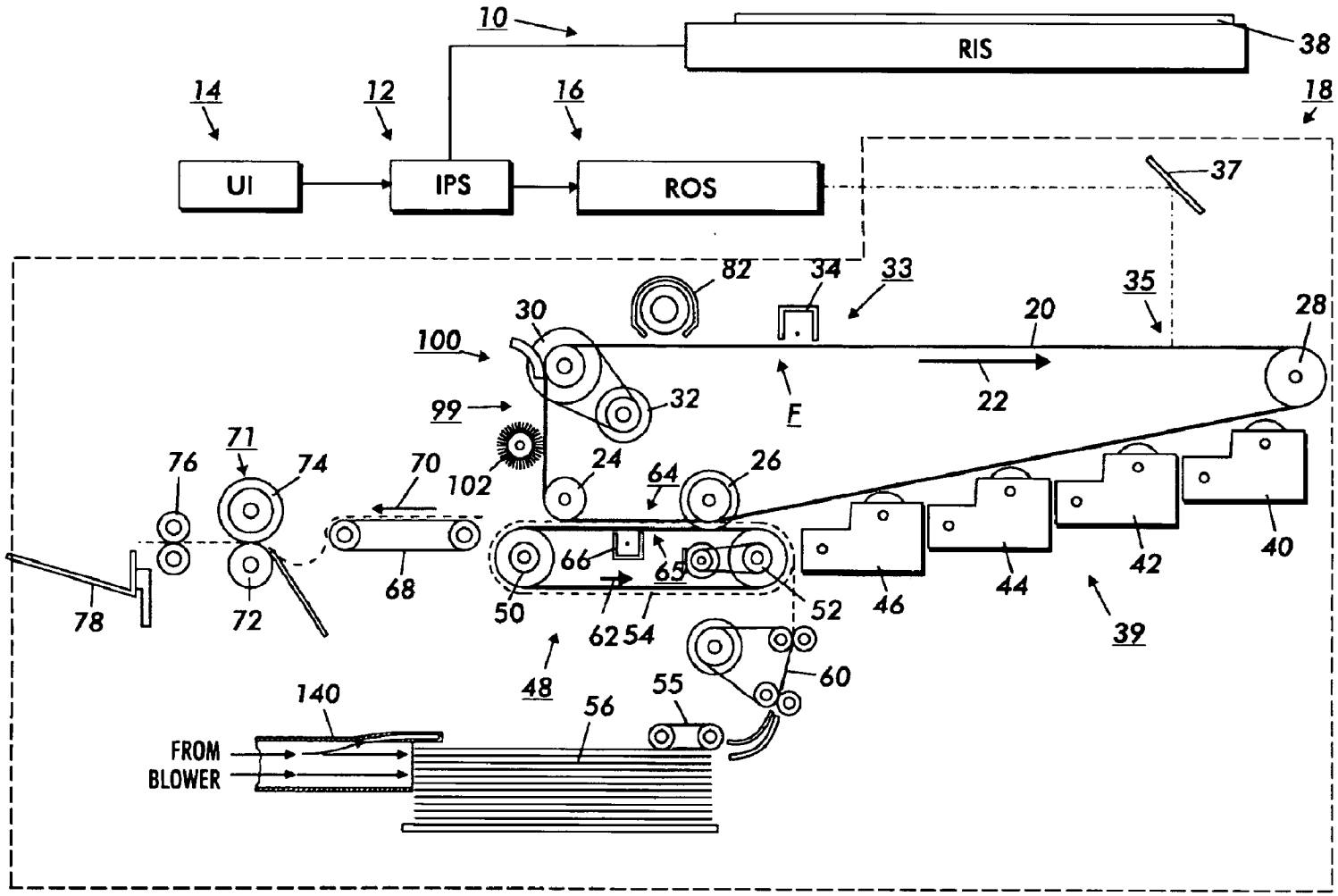
FIG. 1 is a schematic elevational view of an illustrative electrophotographic printing having the features of the present invention therein.
Figure 2:
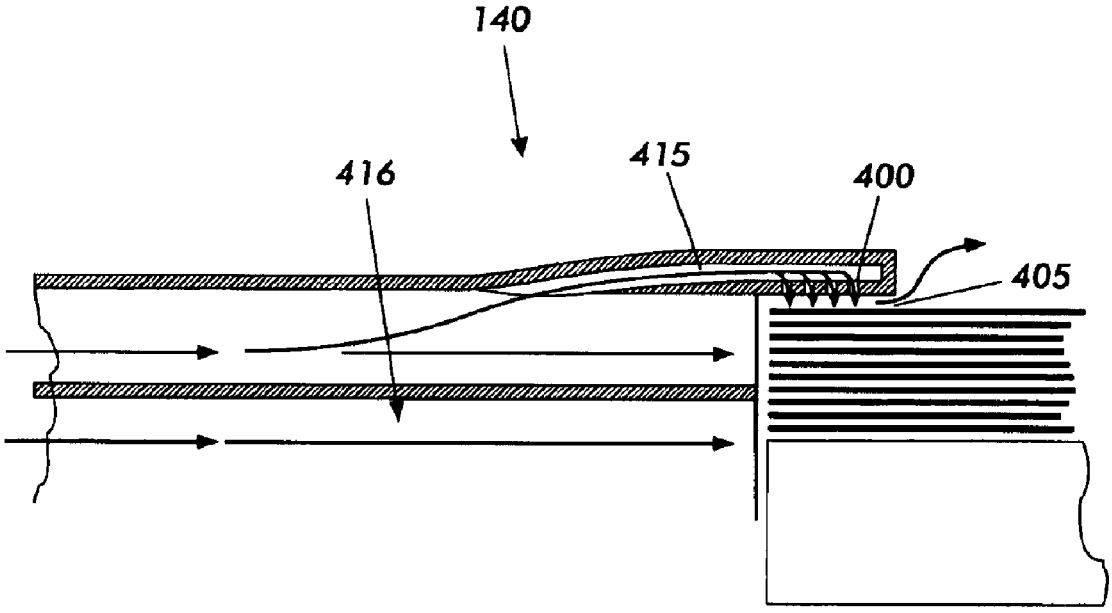
FIGS. 2 and 3 are a schematic of an air plenum of a media feeder employed with the present invention.

While the present invention will hereinafter be described in connection with preferred embodiments, it will be understood that it is not intended to limit the invention to a particular embodiment.

For a general understanding of the features of the present invention, reference is made to the drawings. In the drawings, like reference numerals have been used throughout to designate like elements. It will become evident from the following discussion that the present invention and the various embodiments set forth herein are suited for use in a wide variety of printing and copying systems, and are not necessarily limited in its application to the particular systems shown herein.

By way of a general explanation, FIG. 1 is a schematic elevational view showing an electrophotographic printing machine which incorporates features of the present invention therein. It will become evident from the following discussion that the present invention is equally well suited for use in a wide variety of copying and printing systems, and is not necessarily limited in its application to the particular system shown herein. As shown in FIG. 1, during operation of the printing system, a color or black/white original document 38 is positioned on a raster input scanner (RIS), indicated generally by the reference numeral 10. The RIS contains document illumination lamps, optics, a mechanical scanning drive, and a charge coupled device (CCD array). The RIS captures the entire image from original document 38 and converts it to a series of raster scan lines and moreover measures a set of primary color densities, i.e. red, green and blue densities, at each point of the original document. This information is transmitted as electrical signals to an image processing system (IPS), indicated generally by the reference numeral 12. IPS 12 converts the set of red, green and blue density signals to a set of colorimetric coordinates.

IPS 12 contains control electronics which prepare and manage the image data flow to a raster output scanner (ROS), indicated generally by the reference numeral 16. A user interface (UI), indicated generally by the reference numeral 14, is in communication with IPS 12. UI 14 enables an operator to control the various operator adjustable functions. The operator actuates the appropriate keys of UI 14 to adjust the parameters of the copy. UI 14 may be a touch screen, or any other suitable control panel, providing an operator interface with the system. The output signal from UI 14 is transmitted to IPS 12. IPS 12 then transmits signals corresponding to the desired image to ROS 16, which creates the output copy image. ROS 16 includes a laser with rotating polygon mirror blocks. Preferably, a nine facet polygon is used. ROS 16 illuminates, via mirror 37, the charged portion of a photoconductive belt 20 of a printer or marking engine, indicated generally by the reference numeral 18, at a rate of about 400 pixels per inch, to achieve a set of subtractive primary latent images. ROS 16 will expose the photoconductive belt 20 to record three latent images which correspond to the signals transmitted from IPS 12. One latent image is developed with cyan developer material. Another latent image is developed with magenta developer material and the third latent image is developed with yellow developer material. These developed images are transferred to a copy sheet in superimposed registration with one another to form a multicolored image on the copy sheet. This multicolored image is then fused to the copy sheet forming a color copy.

With continued reference to FIG. 1, printer or marking engine 18 is an electrophotographic printing machine. Photoconductive belt 20 of marking engine 18 is preferably made from a polychromatic photoconductive material. The photoconductive belt 20 moves in the direction of arrow 22 to advance successive portions of the photoconductive surface sequentially through the various processing stations disposed about the path of movement thereof. Photoconductive belt 20 is entrained about transfer rollers 24 and 26, tensioning roller 28, and drive roller 30. Drive roller 30 is rotated by a motor 32 coupled thereto by suitable means such as a belt drive. As roller 30 rotates, it advances belt 20 in the direction of arrow 22.

Initially, a portion of photoconductive belt 20 passes through a charging station, indicated generally by the reference numeral 33. At charging station 33, a corona generating device 34 charges photoconductive belt 20 to a relatively high, substantially uniform potential.

Next, the charged photoconductive surface is rotated to an exposure station, indicated generally by the reference numeral 35. Exposure station 35 receives a modulated light beam corresponding to information derived by RIS 10 having multicolored original document 38 positioned thereat. The modulated light beam impinges on the surface of photoconductive belt 20. The beam illuminates the charged portion of the photoconductive belt to form an electrostatic latent image. The photoconductive belt 20 is exposed three times to record three latent images thereon.

After the electrostatic latent images have been recorded on photoconductive belt 20, the belt advances such latent images to a development station, indicated generally by the reference numeral 39. The development station includes four individual developer units indicated by reference numerals 40, 42, 44, and 46. The developer units are of a type generally referred to in the art as "magnetic brush development units." Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush with fresh developer material. Development is achieved by bringing the brush of developer material into contact with the photoconductive surface. Developer units 40, 42, and 44, respectively, apply toner particles of a specific color which corresponds to the compliment of the specific color separated electrostatic latent image recorded on the photoconductive surface.

The color of each of the toner particles is adapted to absorb light within a preselected spectral region of the electromagnetic wave spectrum. For example, an electrostatic latent image formed by discharging the portions of charge on the photoconductive belt 20 corresponding to the green regions of the original document will record the red and blue portions as areas of relatively high charge density on photoconductive belt 20, while the green areas will be reduced to a voltage level ineffective for development. The charged areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be used to develop the electrostatic latent image formed from a black and white original document. Each of the developer units is moved into and out of an operative position. In the operative position, the magnetic brush is substantially adjacent the photoconductive belt, while in the nonoperative position, the magnetic brush is spaced therefrom. (In FIG. 1, each developer unit 40, 42, 44, and 46 is shown in the operative position.) During development of each electrostatic latent image, only one developer unit is in the operative position, while the remaining developer units are in the nonoperative position. This ensures that each electrostatic latent image is developed with toner particles of the appropriate color without commingling.

After development, the toner image is moved to a transfer station, indicated generally by the reference numeral 65. Transfer station 65 includes a transfer zone, generally indicated by reference numeral 64. In transfer zone 64, the toner image is transferred to a sheet of support material, such as plain paper amongst others. At transfer station 65, a sheet transport apparatus, indicated generally by the reference numeral 48, moves the sheet into contact with photoconductive belt 20. Sheet transport 48 has a pair of spaced belts 54 entrained about a pair of substantially cylindrical rollers 50 and 52. A sheet gripper (not shown in FIG. 1) extends between belts 54 and moves in unison therewith. A sheet is advanced from a stack of sheets 56 disposed on a tray. A feeder 58 according to the present invention advances the uppermost sheet from stack 56 onto a pre-transfer transport 60. Transport 60 advances a sheet (not shown in FIG. 1) to sheet transport 48. The sheet is advanced by transport 60 in synchronism with the movement of the sheet gripper. In this way, the leading edge of the sheet arrives at a preselected position, i.e. a loading zone, to be received by the open sheet gripper. The sheet gripper then closes securing the sheet thereto for movement therewith in a recirculating path. The leading edge of the sheet is secured releasably by the sheet gripper. As belts 54 move in the direction of arrow 62, the sheet moves into contact with the photoconductive belt 20, in synchronism with the toner image developed thereon. In transfer zone 64, a gas directing mechanism (not shown in FIG. 1) directs a flow of gas onto the sheet to urge the sheet toward the developed toner image on photoconductive belt 20 so as to enhance contact between the sheet and the developed toner image in the transfer zone. Further, in transfer zone 64, a corona generating device 66 charges the backside of the sheet to the proper magnitude and polarity for attracting the toner image from photoconductive belt 20 thereto. The sheet remains secured to the sheet gripper so as to move in a recirculating path for three cycles. In this way, three different color toner images are transferred to the sheet in superimposed registration with one another.

One skilled in the art will appreciate that the sheet may move in a recirculating path for four cycles when under color black removal is used. Each of the electrostatic latent images recorded on the photoconductive 25 surface is developed with the appropriately colored toner and transferred, in superimposed registration with one another, to the sheet to form the multicolor copy of the colored original document.

After the last transfer operation, the sheet transport system directs the sheet to a vacuum conveyor 68. Vacuum conveyor 68 transports the sheet, in the direction of arrow 70, to a fusing station, indicated generally by the reference numeral 71, where the transferred toner image is permanently fused to the sheet. The fusing station includes a heated fuser roll 74 and a pressure roll 72. The sheet passes through the nip defined by fuser roll 74 and pressure roll 72. The toner image contacts fuser roll 74 so as to be affixed to the sheet. Thereafter, the sheet is advanced by a pair of rolls 76 to a catch tray 78 for subsequent removal therefrom by the machine operator.

The final processing station in the direction of movement of photoconductive belt 20, as indicated by arrow 22, is a photoreceptor cleaning station, The sequence of operation of the sheet feeder of the present invention is as follows. A stack of paper 56 is placed into the elevator paper tray 120.

Fluffer has air openings 415 and 416. Fluffer 140 is arranged such that it may inject air between sheets in the stack by air opening 416 and on top surface of the sheet by air opening 415 to be fed. The air pressure between sheets helps separate sheets, i.e. puff the sheets up. The air on top of the surface of the sheet to be fed, on the other hand, due to the Venturi effect, creates a vacuum to help pull the sheet to the feeder head. The combined effects improve the speed of the sheet acquisition speed and ensure a single sheet feed.

In the vacuum shuttle feeder before the sheet is acquired to the vacuum feed head a high pressure side port will fluff the stack to prevent multifeeds. With lightweight sheets 49–75 gsm the high pressure fluffer port will blow the sheets up against the feed head into an over fluff condition which could cause misfeeds or multifeeds. The present system uses a baffle with a an air bearing surface that is located 2 mm above the feed head to control the over fluff situation. A problem with the over prior fluff baffle is increased drag to the sheet as it is pulled by the vacuum feed head which resulted in skew or misfeed.

The present invention replaces the over fluff baffle that is used to control the sheets during the fluff cycle with an air bearing surface 400 along the entire width of the sheet that controls the height of the trailing edge of the sheet in the stack as the sheet is being acquired by the vacuum feed head. The air bearing surface 400 eliminates skew because it has reduced the friction and pinch points between the feed head and over fluff baffle. Preferably, the air bearing surface 400 is part of the fluffer port 410. The air source 425 and 430 for the air bearing is tapped off the existing fluffer port via channel 410. Air bearing surface 400 has apertures 405 along the width of the sheet which provides downward force to the trailing edge of the sheet.

Figure 3:
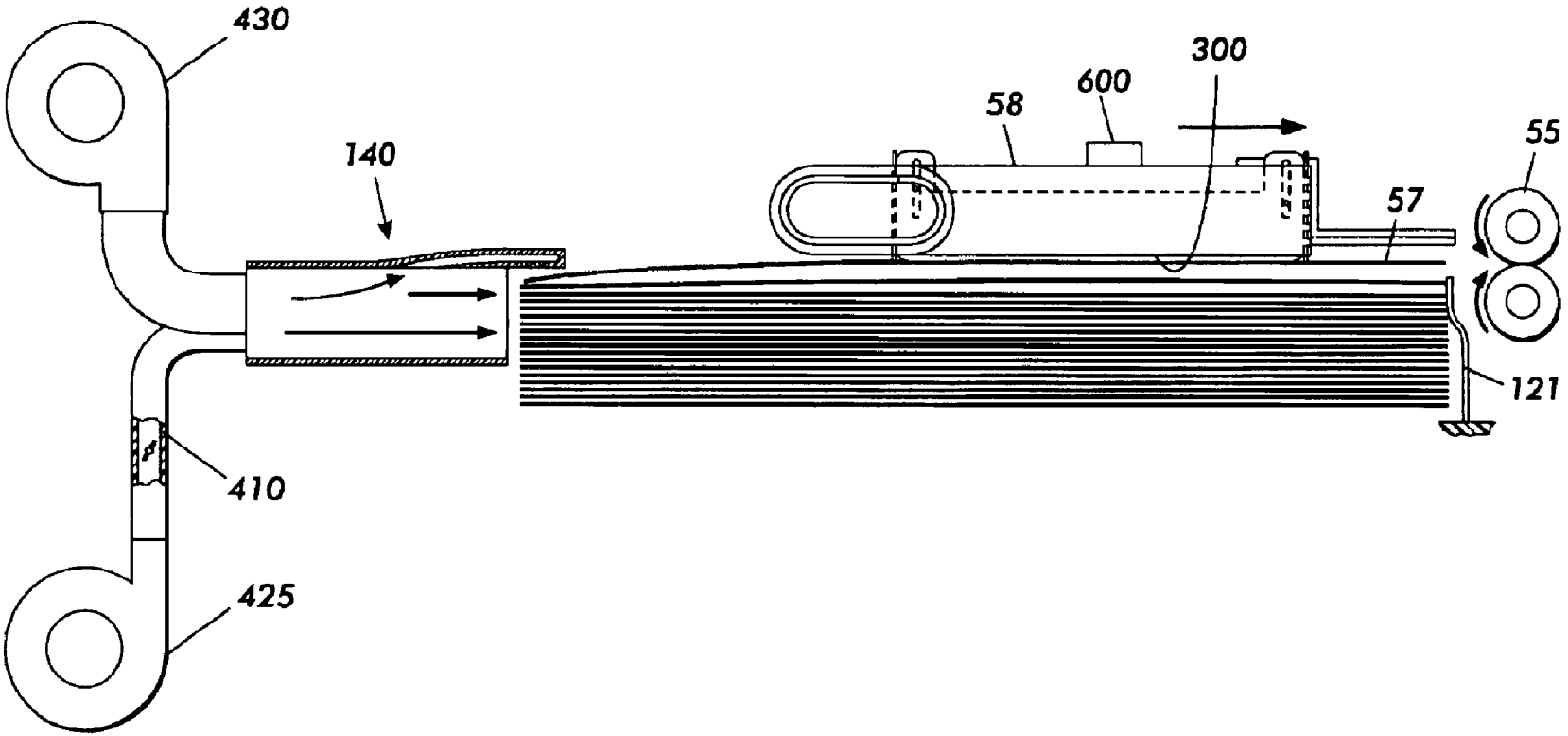

Referring to FIG. 3, feeder plenum 58 is located above the stack 56. The feeder plenum 58 includes a cavity which may be evacuated thereby forming a pressure differential. The difference in pressure between the inside of the feeder plenum 58 and the outside of the feeder plenum 58 forces the supply paper towards the vacuum paper contact surface of the feeder plenum 58 and seal 300. Vacuum paper contact surface employs a corrugated surface composed of a combination of variant sized ribs to reduce the bonding forces between paper surfaces thereby separating sheets on said vacuum paper contact surface.

A seal (not shown) is positioned about the perimeter of plenum 58. Seal is a floating and flexible seal between the vacuum plenum and paper stack. Drive assembly 600 is, attached to air plenum 58 for translating the acquire sheet's leading edge 57 into feed rollers. To further reduce the likelihood of removing other sheets from the stack (i.e., to reduce multifeeds), onto vacuum paper contact surface, the drive assembly 600 translate the air plenum 58 initially in a reverse direction of movement of the feed rollers 55 so that a trailing edge of the acquired sheets abuts against a portion of the sheet tray to generate a buckle area in the acquired sheet. Then, drive assembly translates air plenum in a direction of movement of the feed rollers 55 so that a lead edge of the acquired by the feed rollers 55 above flange 121.

Other embodiments and modifications of the present invention may occur to those skilled in the art subsequent to a review of the information presented herein; these embodiments and modifications, as well as equivalents thereof, are also included within the scope of this invention.

What is claimed is:

1. A sheet feeding apparatus for feeding a stack of sheets in a direction of movement to a process station, comprising:

a sheet tray for holding said stack of sheets;

a paper fluffer, position on a said side portion of said stack of sheets, for blowing air between individual sheets in said stack to keep a top sheet of said stack separated and ready for feeding; and a baffle, position on a top portion of said stack of sheets, for engaging a trailing edge of said top sheet thereby preventing the trailing edge of said top sheet from curling up, said baffle includes an air source for blowing air on a top surface portion of the trailing edge of said top sheet.

2. The apparatus of claim 1, wherein said baffle is an integral portion of said paper fluffer.

3. The apparatus of claim 1, wherein said air sourcing includes a channel for directing air from said paper fluffer to an exit port in said baffle.

4. The apparatus of claim 1, wherein sheets in said stack of sheets have weight between 49 to 75 GSM.

* * * * *